US005865155A

United States Patent [19]

Nagashima

[11] Patent Number: 5,865,155

[45] Date of Patent: Feb. 2, 1999

[54] HAND LEVER DEVICE

[75] Inventor: Akira Nagashima, Kanagawa, Japan

[73] Assignee: Kioritz Corporation, Tokyo, Japan

[21] Appl. No.: 898,425

[22] Filed: Jul. 22, 1997

[30] Foreign Application Priority Data

Jul. 22, 1996 [JP] Japan ..... 8-192575

[51] Int. Cl.[6] ..... F02D 11/02; F02D 9/00

[52] U.S. Cl. ..... 123/398; 123/401; 56/12.7; 74/500.5; 74/501.5 R

[58] Field of Search ..... 123/398, 400, 123/403; 56/12.7; 74/500.5, 501.5 R

[56] References Cited

U.S. PATENT DOCUMENTS

| | | | |
|---|---|---|---|
| 4,138,601 | 2/1979 | Nakamura et al. . | |
| 4,226,021 | 10/1980 | Hoff | 56/12.7 |
| 4,282,652 | 8/1981 | Ballas, Sr. | 56/12.7 |
| 4,611,502 | 9/1986 | Gregory . | |
| 4,759,128 | 7/1988 | Katoh et al. | 56/12.7 |
| 4,798,185 | 1/1989 | Driggers | 123/400 |
| 4,916,886 | 4/1990 | Nakamura et al. | 56/12.7 |
| 5,517,967 | 5/1996 | Nalayama . | |
| 5,551,395 | 9/1996 | Isaacs et al. | 123/403 |
| 5,636,644 | 6/1997 | Nickel | 56/12.7 |
| 5,664,543 | 9/1997 | Taomo et al. | 123/400 |
| 5,685,271 | 11/1997 | Taomo, et al. . | |
| 5,718,052 | 2/1998 | Taomo et al. | 123/398 |

FOREIGN PATENT DOCUMENTS

| | | |
|---|---|---|
| 196 24 284 | 1/1997 | Germany . |
| 196 24 873 | 1/1997 | Germany . |
| 57-19944 | 4/1982 | Japan . |
| 7-106098 | 11/1995 | Japan . |
| 8-303262 | 11/1996 | Japan . |

OTHER PUBLICATIONS

Nakayama Yoshiki, "Throttle Device for Internal Combustion Engine", EPO Patent Abstracts of Japan, Publ. No. 02163427, Jun. 22, 1990.

*Primary Examiner*—Erick R. Solis
*Attorney, Agent, or Firm*—Pillsbury Madison & Sutro LLP, Intellectual Property Group

[57] ABSTRACT

A hand lever device is disclosed which allows movable members such as a main lever to be retained appropriately in case members even in a time when a case is dismounted or separated from a handle. In the hand lever device, the case has a ternary structure composed of one side case member (21), an intermediate case member (22) and the other side case member (23). The case (20) is dismounted from the handle (7) by detaching the other case member (23) from the one side case member (21) and the intermediate case member (22). The main lever (30) for drawing a cable (17) connected to a driven member (CV) is retained between the one side case member (21) and the intermediate case member (22) even in a time when said case (20) is dismounted or separated from the handle (7).

9 Claims, 11 Drawing Sheets

HAND LEVER DEVICE

BACKGROUND OF THE INVENTION

1. Field of the Invention

The present invention relates to a hand lever device for operating a driven member, such as a throttle valve, of an internal combustion engine via a cable. In particular, the hand lever device is preferably mounted on a working machine, such as a hedge trimmer or brush cutter, in the vicinity of a hand grip so that it is easy and convenient to operate such a throttle valve or the like via a throttle cable or the like.

2. Description of the Prior Art

For example, in a working machine such as a hedge trimmer and brush cutter which comprises an operative portion including a cutting blade or the like driven by an internal combustion engine, a hand lever device is provided for controlling the degree of opening of a throttle valve of the internal combustion engine. Such a hand lever is mounted in the vicinity of a grip of a U-shaped handle, a bar handle or the like of the working machine so as to provide manual control of the output force of the internal combustion engine.

The hand lever device is generally provided with a throttle trigger (throttle lever) operated by operator's fingers with the throttle lever being pivotally operated to thereby control the degree of opening of the throttle valve via a throttle cable. In general, the throttle valve is always biased toward the direction of minimum valve opening that allows the engine to idle. Accordingly, the throttle valve is normally kept at the idle opening position and, when the throttle cable is drawn in a predetermined amount to eliminate play, it begins to open from the opening position for idling (slow running) of the engine toward an opening position for operation (higher speed running) of the engine.

Such known hand lever devices for controlling throttle valve settings include an automatic return to an idle setting type and an immobilizable type. In the former type, when such a throttle lever is released from a pivotally operated position, the lever is automatically returned to its original idle position setting, thereby moving the throttle valve to its idle setting. In the latter type, when fingers are released from a throttle lever, the throttle lever is held immobilized at a desired pivotally operated position (see Japanese Examined Utility Model Publication No.19944/1982, etc.).

In the auto-return type, when fingers are released from the throttle lever, the engine is automatically returned to idling condition. Consequently, when the auto-return type is used in a working machine, where the output force of the engine is transmitted to an operative portion including a cutting blade via a centrifugal clutch, the centrifugal clutch is brought into a condition for disconnection to cut off the transmission of the driving force to the operative portion. Accordingly, the operation of the machinery can immediately be stopped by returning the throttle valve to the opening degree for idle running if an accident occurs, thereby advantageously attaining improved safety. On the other hand, the throttle valve must be held continuously by fingers at a desired pivotally operated position to achieve desired operation of the machinery. This causes problems in that this type is awkward with respect to intermediate opening degrees, the fingers are susceptible to fatigue, and the speed of the engine is likely to be unstable.

In general, it is desired from the viewpoint of operational convenience that a lever which is pivotally operated by fingers, for example, a throttle lever be alternatively shifted between two positions, i.e., a released position and a set position (pressed position) without being suspended at any intermediate position. Accordingly, it is preferred in terms of operability that the lever be set in the same pivotally operated position (set position) regardless of whether an intermediately open condition (partially open condition) or the fully open condition (W.O.T.) of a throttle valve is intended.

On the other hand, the immobilizable type is capable of solving the above problems associated with the auto-return to idle running opening degree type. The immobilizable type advantageously holds the throttle lever at a desired pivotally operated position without the throttle lever being held by the operator's fingers. This enables easy cutting operation because fingers are liberated from holding it. However, since additional operation is required to release the throttle lever from the immobilized position, it is impossible to immediately stop the machinery even if an accident occurs. Accordingly, there is a problem that, in terms of safety, the immobilizable type is inferior to the auto-return to idle running opening degree type.

Further, in either type, when the throttle lever which has once been released to suspend operation is returned to the previous opening degree to resume the operation (as is often the case with a working machine such as a brush cutter), the pivotally operated position of the throttle lever must be readjusted. In view of such cumbersome operation, there is still room for improvement in operability.

To solve the problems in the conventional hand lever devices, the present assignee have previously proposed, for example, a hand lever device comprising a main lever and a sub-lever which are pivotally operated, wherein the sub-lever is adapted to draw a cable connected to a driven member via a cable turnaround member such as a pulley, and the cable turnaround member is moved by the main lever (as disclosed in Japanese Laid Open Patent Application No.303262/1996).

According to such a hand lever device, advantages can be obtained that a throttle valve as a driven member can be adjusted appropriately in its opening degree via a cable and kept at a desired opening degree and yet immediately returned to the minimum opening degree (the opening degree for idle running) to ensure high safety, and that fatigue of fingers can be diminished, and that the throttle valve can be brought to the opening degree at which it had stood before it was returned to the minimum opening degree without necessity of readjustment.

In the proposed hand lever device, however, draw amount of the throttle cable directly corresponds to the amount of the pivotal movement of the main lever. Accordingly, the main lever must be pivotally operated in a relatively large amount in order to draw the throttle cable in a necessary amount. For obtaining a required amount of pivotal movement of the main lever, it is required to provide a relatively large space for pivotal operation of the main lever between a grip of the handle and the main lever. As a result, the hand lever device is not satisfactory in size and weight and also in terms of operability.

To solve the above problem, the present assignee proposed a hand lever device having the following structure as a basic embodiment of the present invention. The proposed hand lever device comprises:

a case to be mounted on a handle, a main lever pivotally supported by the case for drawing a cable connected to a driven member via a cable turnaround member, a draw amount magnifying mechanism interposed between the main lever and the cable in the case for magnifying amount of pivotal movement of the main lever to draw the cable in a magnified amount, and a position adjusting mechanism for moving the cable turnaround member toward the cable drawing direction and holding the cable turnaround member at a desired position.

Incidentally, conventional hand lever devices generally have a case of a binary structure (composed of right and left case members) for supporting/containing movable members such as a main lever, as described, for example, in Japanese Examined Patent Publication No.106098/1995. The right and left case members which constitute the case are put together with a handle held therebetween and they are tightened with bolts or the like to mount the hand lever device on the handle.

In such a conventional hand lever device having a case of a binary structure, however, since movable members such as a main lever are supported/contained between the right and left case members constituting the case, it is difficult to appropriately retain the movable members such as the main lever in (one of) the case members in a time when the right and left case members are separated, i.e., a time when the case is dismounted or separated from the handle, for example, in a time before mounting of the hand lever device on the handle, or in a time of maintenance. Accordingly, mounting of the hand lever device on the handle and maintenance are cumbersome.

Further, since such a conventional hand lever device is mounted on a handle only by putting right and left case members constituting a case together and tightening them with bolts or the like, there is a problem that the case as a whole is likely to rotate or longitudinally move relative to the handle. Such rotation or movement of the case relative to the handle results not only in impairment of operability but also in delicate shift of a front end of the cable. Accordingly, draw amount of the cable is not necessarily constant with respect to given amounts of pivotal movements of a main lever and a sub-lever. Consequently, opening degree of a throttle valve or the like cannot be controlled precisely.

SUMMARY OF THE INVENTION

The present invention has been made in view of these problems. It is, therefore, an object of the present invention to provide a hand lever device which allows movable members such as a main lever to be appropriately retained in case members even in a time when a case is dismounted or separated from a handle, thereby being capable of carrying out mounting thereof on the handle and maintenance.

It is another object of the present invention to provide a hand lever device having a relatively simple structure, which is capable of surely preventing a case from rotating or moving relative to a handle.

To achieve the above objective, a hand lever device according to the present invention basically comprises:

a case to be mounted on a handle, and a main lever pivotally supported by the case for drawing, via a cable turnaround member, a cable connected to a driven member. In a preferred embodiment, a draw amount magnifying mechanism is interposed between the main lever and the cable in the case for magnifying amount of drawing of the cable by the main lever, and a position adjusting mechanism may be provided for holding the cable turnaround member at a desired position.

The case has a ternary structure composed of one side case member, an intermediate case member and the other side case member, and the case is dismounted from the handle by detaching the other case member from the one side case member and the intermediate case member. The main lever, the draw amount magnifying mechanism, the turnaround member and the position adjusting mechanism are retained by means only of the one side case member and the intermediate case member even in a time when said case is dismounted or separated from the handle.

When the hand lever device according to the present invention which is constructed as described above is mounted on the handle, movable members such as the main lever, the draw amount magnifying mechanism, the turnaround member and the position adjusting mechanism are placed and supported between the one side case member and the intermediate case member, and then the one side case member and the intermediate case member are tightened together with screws or the like.

Then, the resulting partial assembly of the one side case member and intermediate case member, which supports therein the movable members, and the other side member are put together with the handle held therebetween and they are tightened by the screws or the like. The one side case member, the intermediate case member and the other side member which constitute the case are thereby fixedly mounted on the handle.

The hand lever device of the present invention which has been mounted on the handle in this manner is dismounted from the handle by detaching the other side case member from the one side case member and the intermediate case member combined therewith.

In a time when the case is dismounted and the one side case member, the intermediate case member and the other side case member which constitute the case are removed from the handle as described above, for example, in a time before mounting of the hand lever device on the handle, or in a time of maintenance, the movable members such as the main lever, the draw amount magnifying mechanism, the turnaround member and the position adjusting mechanism are retained by the one side case member and the intermediate case member.

By virtue of this, in the hand lever device of the present invention, mounting thereof on a handle, maintenance and the like can be carried out far easily as compared with conventional hand lever devices of a binary case structure which have a disadvantage that it is difficult to appropriately retain movable members in (one of) case members.

Further, in a preferred embodiment of the present invention, at least one of the handle and one case member (one of the one side case member, the intermediate case member and the other case member) is provided with a cavity and the other is provided with a protrusion to be fitted in the cavity. When the case members are mounted on the handle, the case as a whole is mounted on the handle with the protrusion fitted in the cavity.

By virtue further of the fact that the case is fixedly mounted on the handle with the protrusion fitted in the cavity which are provided in the handle and the case member, the case is prevented from rotating relative to the handle and also prevented from moving in the longitudinal direction by the fitting between the cavity and the protrusion.

Accordingly, stable operability is always obtained, and shift of the front end of the cable is not caused, and draw amount of the cable is constant with respect to given amounts of operation of the main lever and the position adjusting mechanism. Consequently, opening degree of a throttle valve or the like can be controlled precisely.

DESCRIPTION OF THE PREFERRED EMBODIMENTS

In the following, an embodiment of the present invention will be described with reference to the accompanying drawings.

Figure 1:
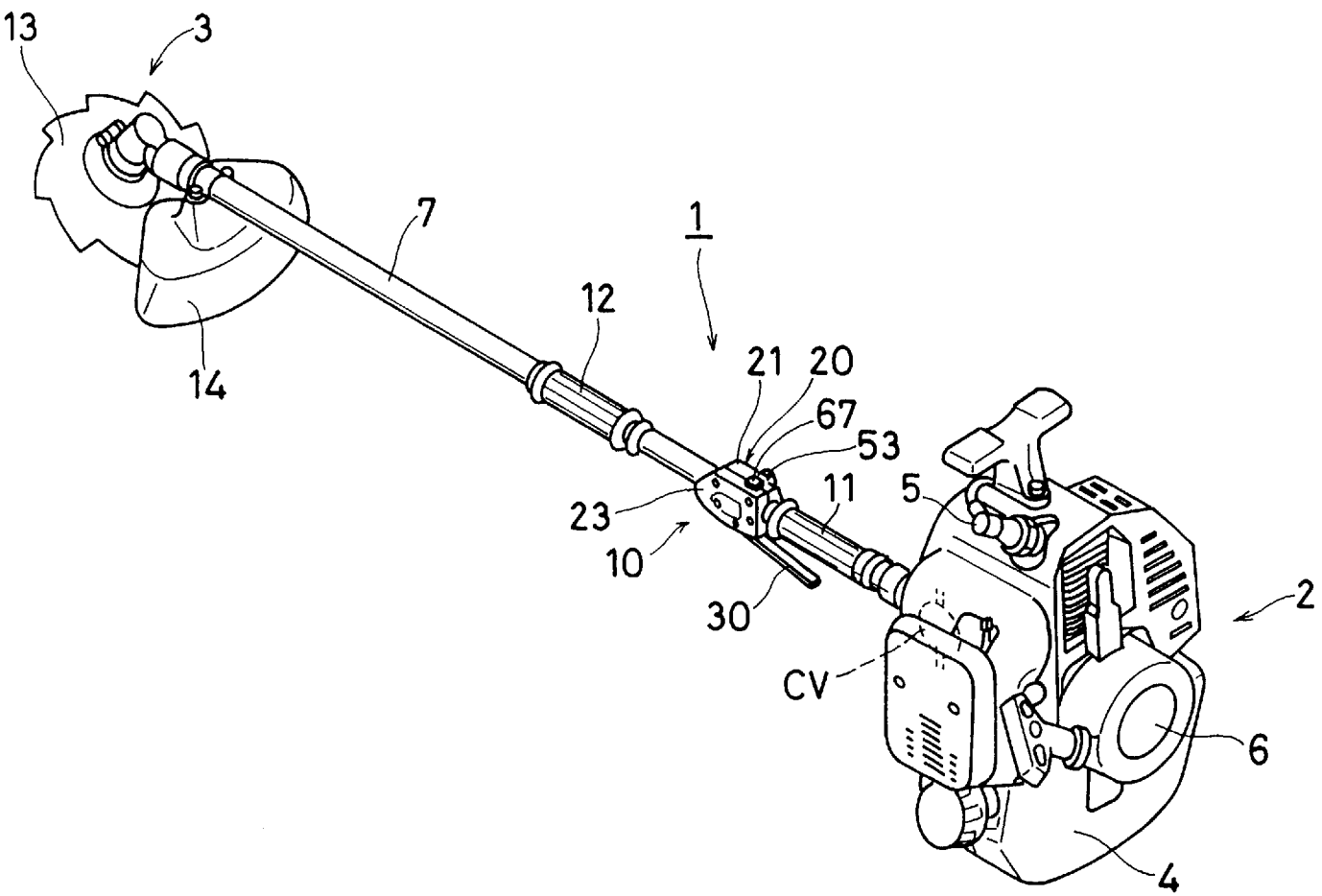
FIG. 1 is a perspective view showing an example of a brush cutter adopting one embodiment of the hand lever device according to the present invention.

FIG. 1 shows an example of a brush cutter employing one embodiment of the hand lever device according to the present invention. The illustrated brush cutter 1 comprises a bar handle (operating rod) 7 provided with grips 11, 12 spaced a predetermined distance apart, and an operative portion 3 provided on the distal end of the bar handle 7. The operative portion 3 includes a cutting blade 13, a safety cover 14 and so forth. The brush cutter 1 further comprises an internal combustion engine 2, for example, a small air-cooled two-cycle gasoline engine, which is disposed on the proximal end of the bar handle 7. The engine 2, which is provided with a recoil starter 6 and a fuel tank 4, provides driving power for driving the cutting blade 13 via a drive shaft (not shown) extending through and within the bar handle 7. The internal combustion engine 2 is equipped with a carburetor (not shown) having a throttle valve CV and a spark plug 5.

Figure 5:
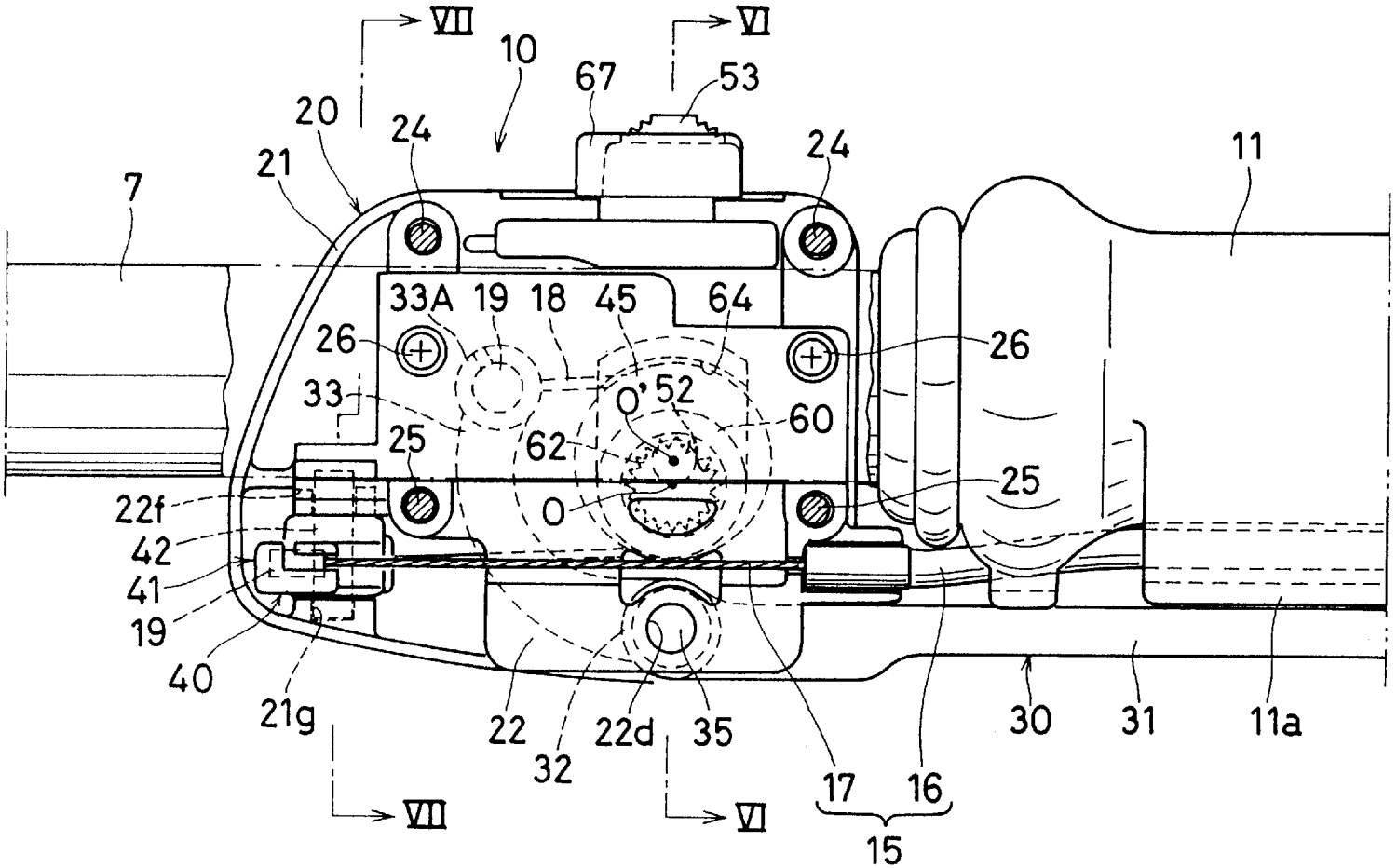
FIG. 5 is an enlarged left side view showing the hand lever device in FIG. 2 with the left case member removed.

In this example, the throttle valve CV is always biased in the direction of a minimum degree of opening (for an idle condition). When a throttle cable (inner cable) 17 connected thereto (as shown in FIG. 5), which will be described below, is drawn from non-operating position in a predetermined amount to eliminate play, the throttle valve CV begins to open from the minimum idle opening position.

One embodiment of the hand lever device 10, according to the present invention, is provided in the vicinity of the grip 11, which is one of the grips 11 and 12 that is gripped generally by an operator's right hand. The hand lever 10 is used to adjust the degree of opening of the throttle valve CV.

Figure 2:
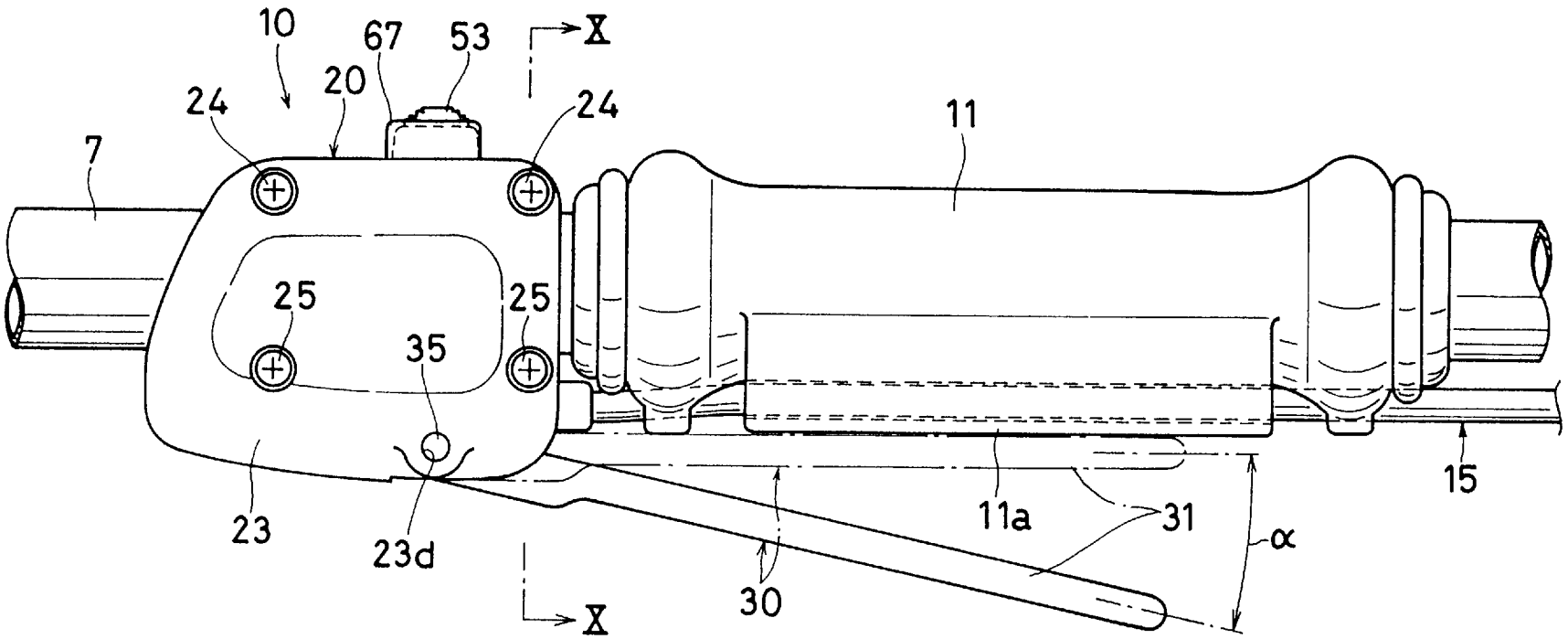
FIG. 2 is a left side view showing the one embodiment of the hand lever device according to the present invention.
Figure 3:
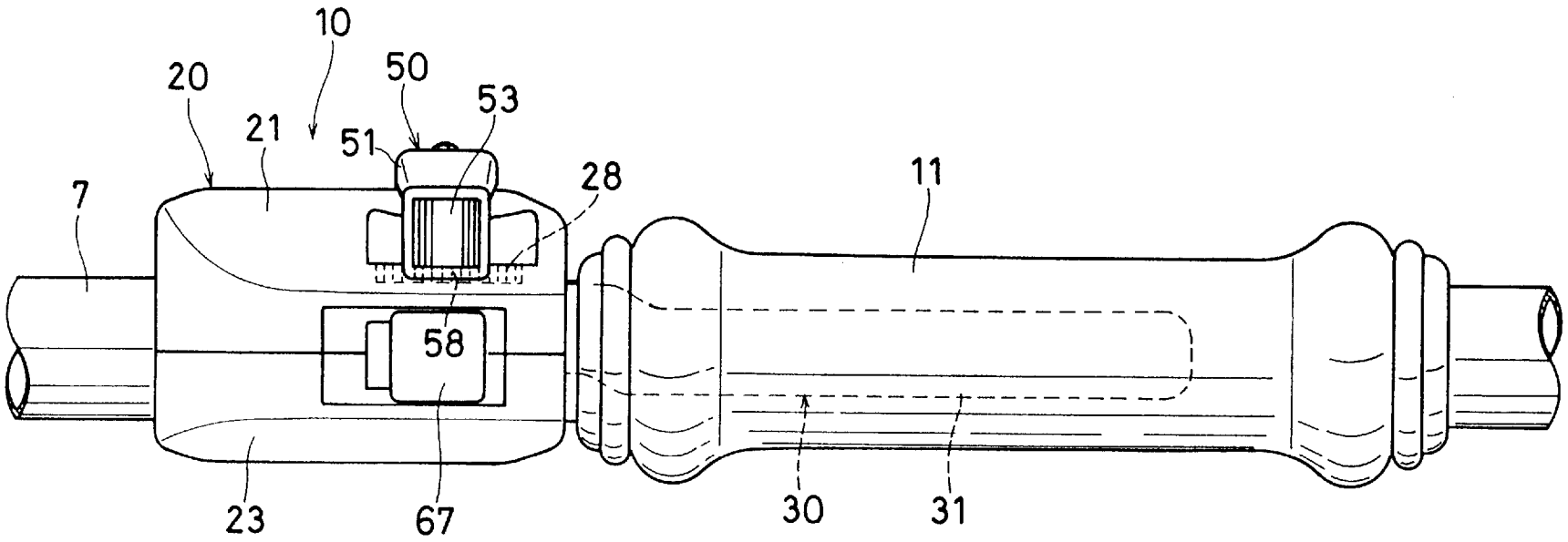
FIG. 3 is a plan view showing the one embodiment of the hand lever device according to the present invention.
Figure 4:
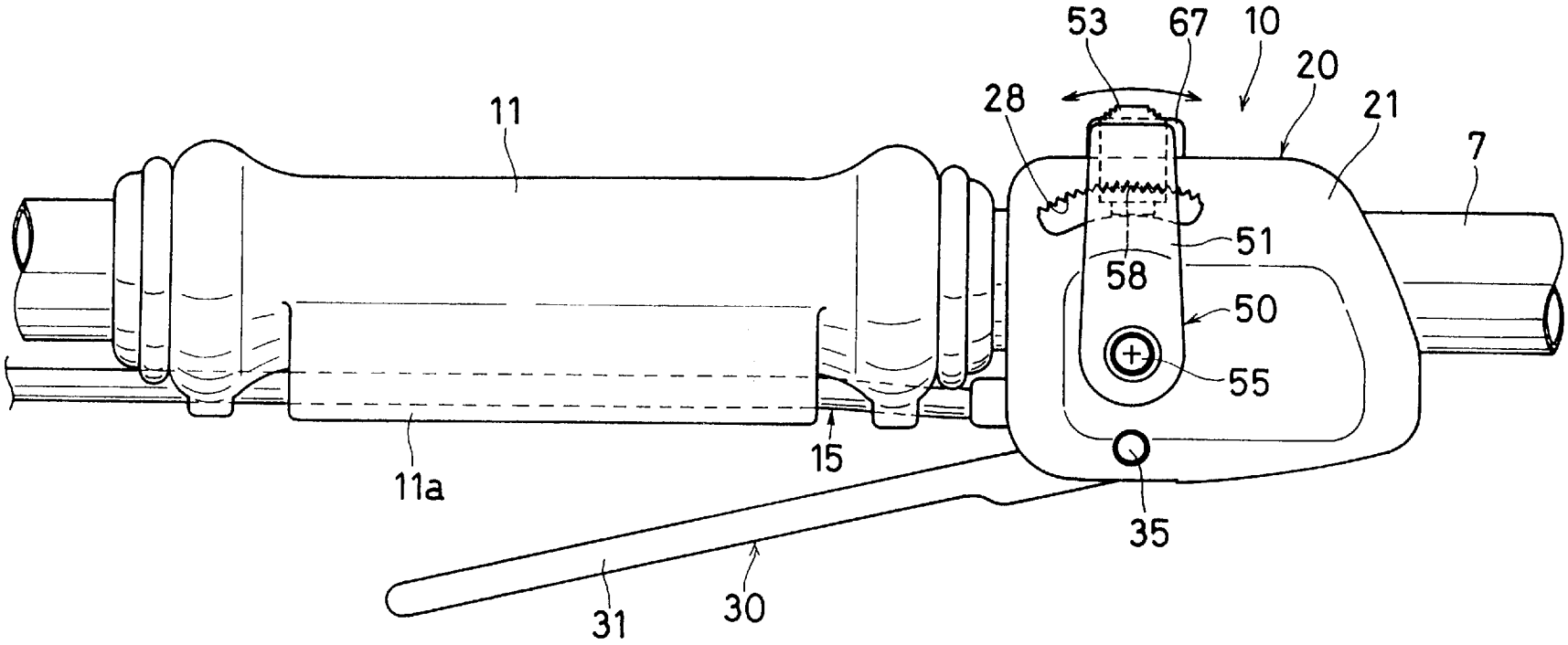
FIG. 4 is a right side view showing the one embodiment of the hand lever device according to the present invention.

As shown in FIGS. 2 to 4, the hand lever device 10 has a case 20 fixedly mounted on the bar handle 7 in the vicinity of the proximal grip 11. In the case 20, a main lever 30 has its one end pivotally held for drawing the throttle cable 17 extending through and within an outer tube 16 of a Bowden cable 15 connected to the throttle valve CV.

Figure 6:
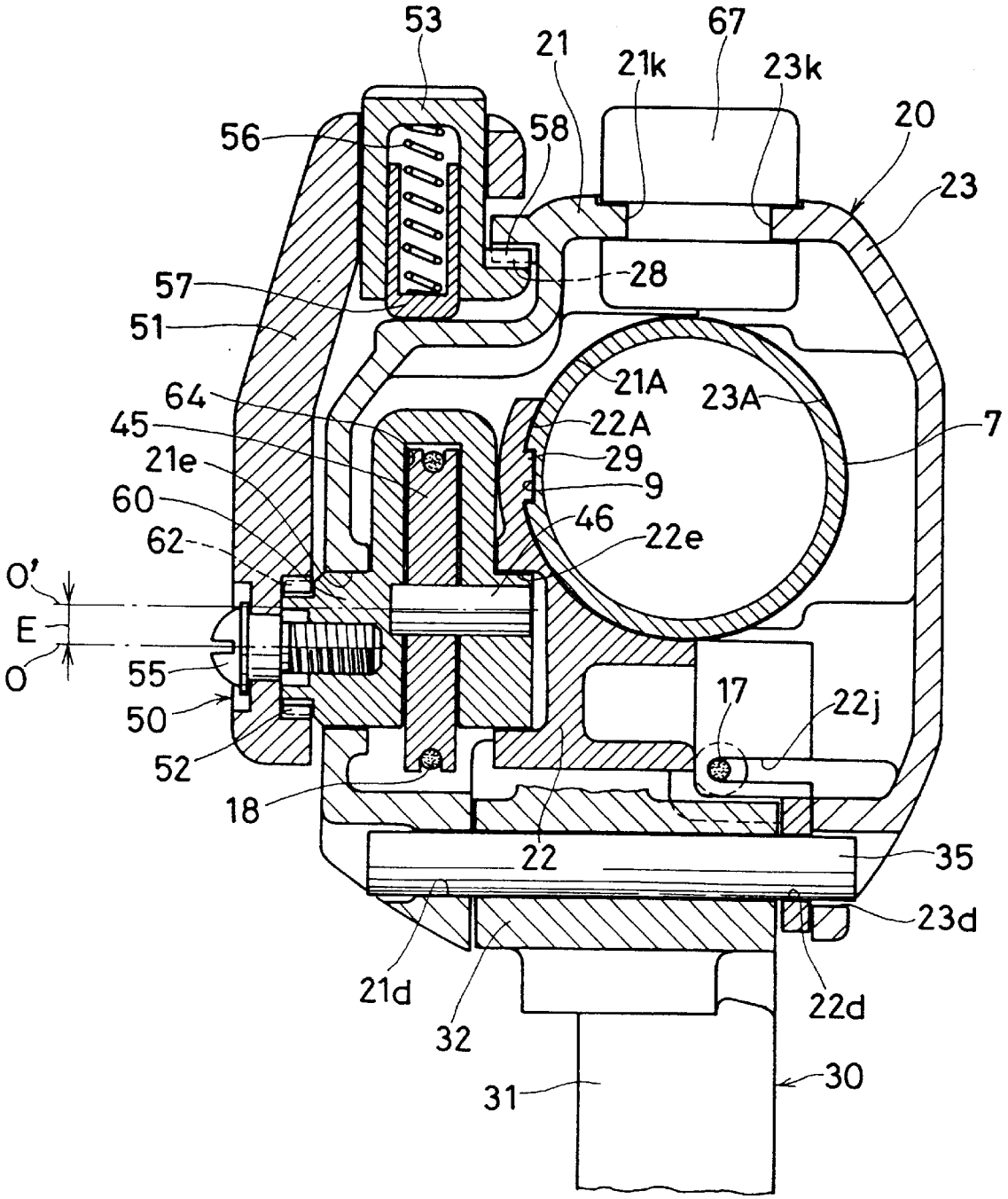
FIG. 6 is a sectional view taken along the line VI—VI and viewed in the direction of the arrows in FIG. 5.
Figure 7:
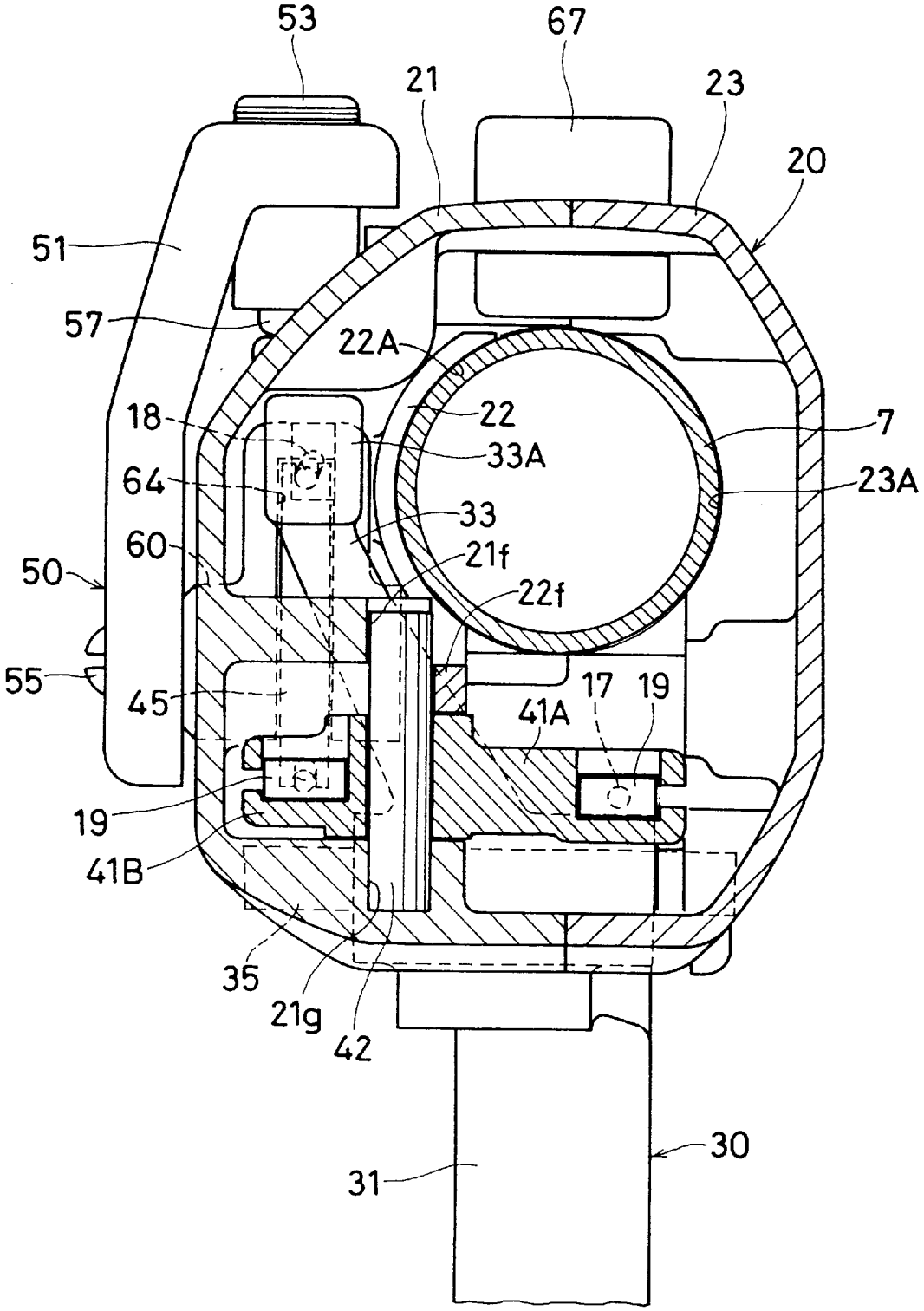
FIG. 7 is a sectional view taken along the line VII—VII and viewed in the direction of the arrows in FIG. 5.

The case 20 has a ternary structure composed of a right case member 21, an intermediate case member 22 and a left case member 23 which are made of a synthetic resin, as well seen with reference to FIGS. 6 and 7.

Each of the right and left case members 21, 23 has a substantially rectangular tray-like appearance. As well seen with reference to FIG. 1 and FIG. 10 which is a sectional view taken along the line X—X and viewed in the direction of the arrows in FIG. 2, each of the right and left case members 21, 23 is provided with four holes in total, i.e., two upper holes and two lower holes. Specifically, the right and left case members 21, 23 are provided with threaded holes 21*a*, 21*a*, 21*b* and 21*b* and through holes 23*a*, 23*a*, 23*b* and 23*b*, respectively. Upper screws 24, 24 are inserted into the upper threaded holes 21*a*, 21*a* through the upper through holes 23*a*, 23*a* and then tightened, and lower screws 25, 25 are inserted into the lower threaded holes 21*b*, 21*b* through the lower through holes 23*b*, 23*b* and then tightened.

The right and left case members 21, 23 are thereby fixedly fitted over the bar handle 7 with the intermediate case member 22 interposed therebetween and with semi-circular abutting portions 21A, 21A, 23A and 23A, which are formed at the front and rear ends thereof, abutting upon the circumferential surface of the bar handle 7 to hold the bar handle 7 therebetween.

Figure 9:
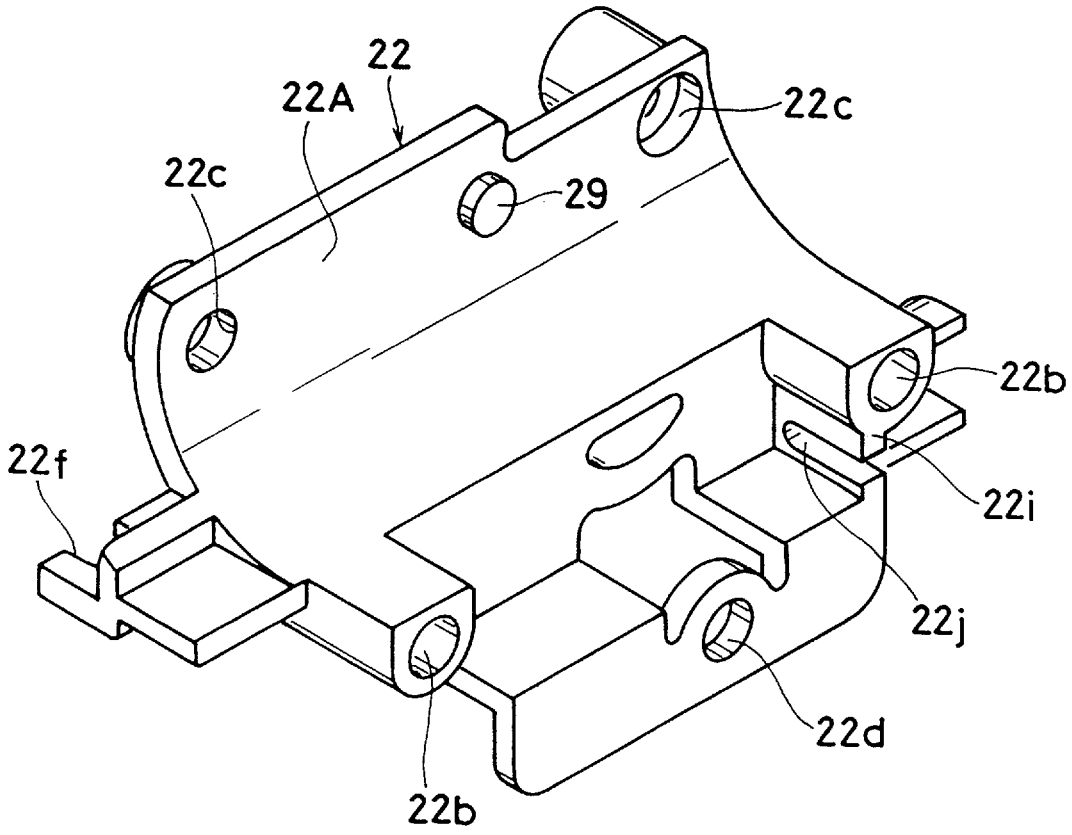
FIG. 9 is a perspective view of an intermediate case member of the hand lever device shown in FIG. 5.
Figure 10:
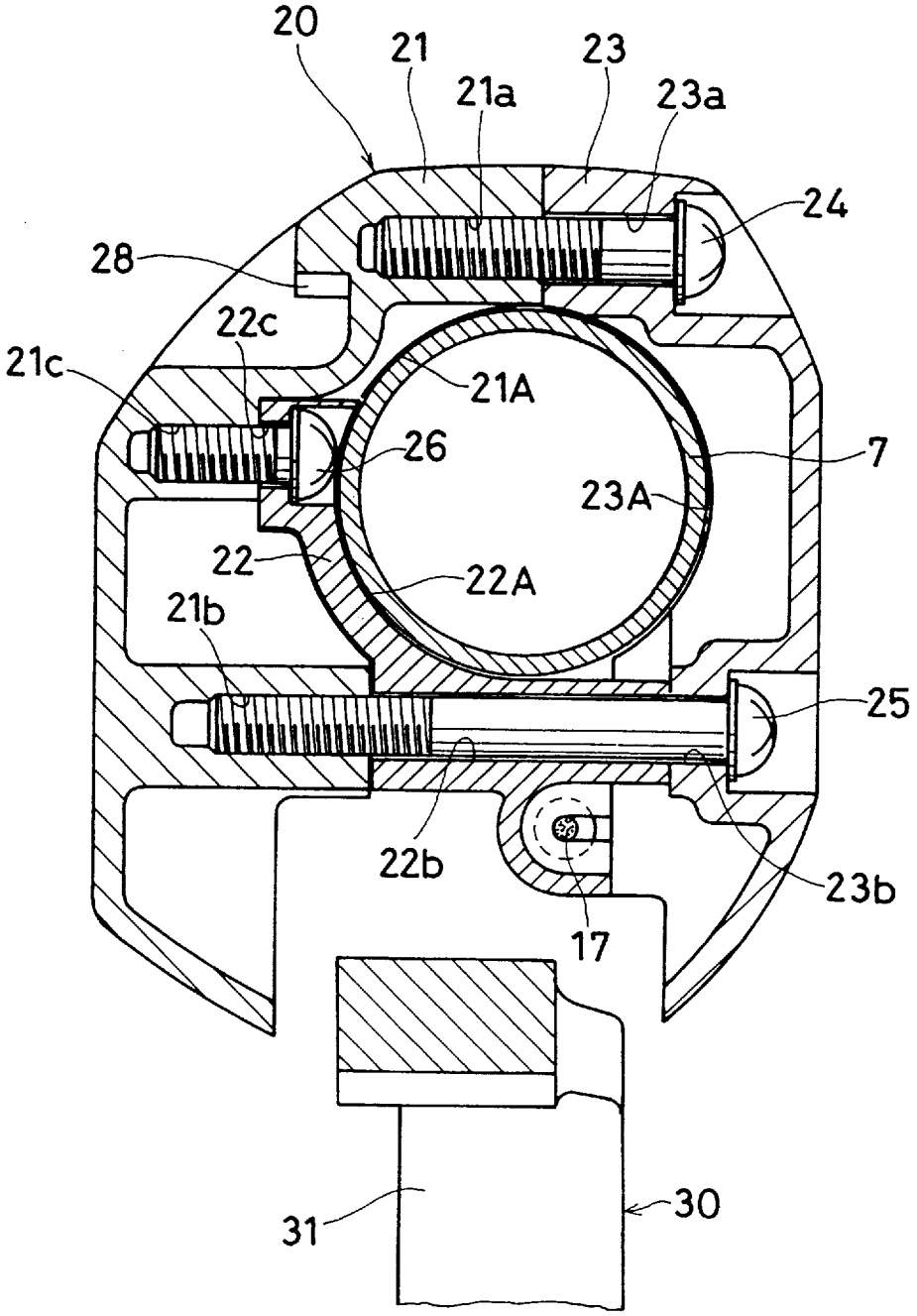
FIG. 10 is an enlarged sectional view taken along the line X—X and viewed in the direction of arrows in FIG. 2.

As well seen with reference to FIG. 5 showing the hand lever device 10 with the left case member 23 removed and FIG. 9 showing the intermediate case member 22 in isolation as well as FIG. 10, the intermediate case member 22 interposed between the right and left case members 21, 23 is located between the lower threaded holes 21*b*, 21*b* and the lower through holes 23*b*, 23*b* and provided with through holes 22*b*, 22*b* for insertion of the screws 25, 25. The intermediate case member 22 is further provided with an abutting wall portion 22A having a semi-circular section, and the abutting wall portion 22A has its upper portion provided with through holes 22*c*, 22*c* in the vicinity of the front and rear ends thereof. Through the through holes 22*c*, 22*c*, screws 26, 26 are inserted into the threaded holes 21*c*, 21*c* and tightened. The intermediate case member 22 is thereby fixedly attached to the right case member 21 by the screws 26, 26.

Further, the abutting wall portion 22A of the intermediate case member 22 is provided with a rotation preventive protrusion 29 fitted into a circular blind hole 9 as a cavity formed at about the middle level of the right side of the circumferential surface of the tubular bar handle 7 (as shown in FIG. 6).

As well seen with reference to FIGS. 5 to 8, the main lever 30 pivotally held by the case 20 comprises a substantially straight operating portion 31 pivotally operated by fingers in such a manner that it is brought closer to a lever rest 11*a* formed at the bottom of the proximal grip 11, a cylindrical portion 32 loosely fitted on a pivot pin 35, and a curved portion 33 having its base end connected to the cylindrical portion 32 and the other end portion upwardly incurvated. The right end of the pivot pin 35 is press-fitted through an insertion hole 21*d* formed near the rear bottom corner of the right case member 21, and the left end of the pivot pin 35 is press-fitted through an insertion hole 22*d* formed in the intermediate case member 22 and loosely inserted through an insertion hole 23*d* formed in the left case member 23.

In this embodiment, the throttle cable 17 is drawn by the main lever 30 constructed as described above via a draw amount magnifying mechanism 40 and a pulley 45 (see FIG. 5) as a cable turnaround member.

Figure 8:
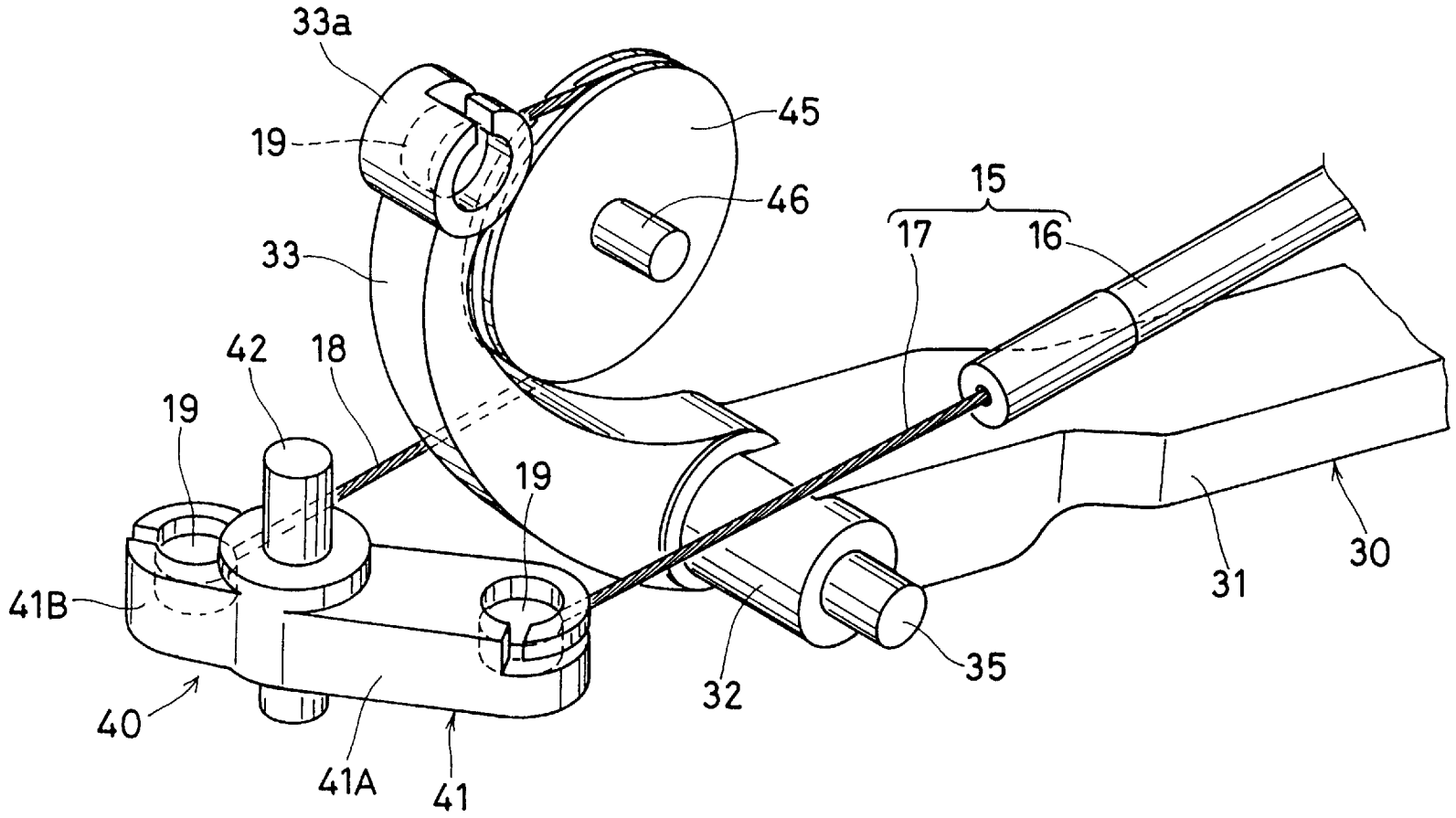
FIG. 8 is a perspective view schematically showing a draw amount magnifying mechanism and cooperative members.

As well seen with reference to FIGS. 7 and 8, the draw amount magnifying mechanism 40 comprises a lever piece 41 pivotally mounted on a pivot pin 42 having its one end supported by a pin receiving hole 21*g* formed in a from bottom portion of the right case member 21 and its the other end supported by a pin supporting portion 21*f* formed at about the middle level of the right case member 21 and a pin supporting portion formed in the intermediate case member 22. A terminal metal piece 19 attached to the front end of the throttle cable 17 is fitted in an end portion (a left end portion) of a longer half 41A of the lever piece 41.

The front end of the outer tube 16 of the Bowden cable 15, through which the throttle cable 17 extends, is anchored in a retaining portion 22*i* formed in the intermediate case member 22. The throttle cable 17 is led through a slit 22*j* formed at the front end of the retaining portion 22*i* to the longer half 41A of the lever piece 41 and connected thereto.

In an end portion (a right end portion) a shorter half 41B of the lever piece 41 and a cylindrical end 33*a* of the curved portion 33 of the main lever 30, terminal metal pieces 19, 19 attached to the ends of a turnaround cable 18 reeved around the pulley 45 as a cable turnaround member and thereby turned around are fitted respectively.

In such a structure, as well seen with reference to FIG. 8, when the operating portion 31 of the main lever 30 is pivotally operated in such a direction that it is brought closer to the proximal grip 11, the shorter half 41B of the lever piece 41 is backwardly drawn via the turnaround cable 18. The lever piece 41 is thereby rotated in the clockwise direction when viewed in plan. In consequence thereof, the throttle cable 17 is forwardly drawn by the longer half 41A of the lever piece 41. In this connection, the draw amount in which the throttle cable 17 is drawn by the main lever 30 is magnified according to the ratio between the longer and shorter halves 41A, 41B, i.e., the longer half/shorter half lever ratio.

In this embodiment, a position adjusting mechanism 50 is provided for moving the pulley 45 toward the throttle cable drawing direction (backward direction) to hold the pulley 45 immobilized at an intended position.

As well seen with reference to FIGS. 4 to 7, the position adjusting mechanism 50 comprises a pivot pin 60 provided with a serrated pin portion 62 at its right end and having a covering 64 for containing the pulley 45, a sub-lever 51 provided with a serrated portion 52 in mesh with the serrated pin portion 62 and fixedly attached to the right end of the pivot pin 60 by a screw 55. The left end of the pivot pin 60 is journalled by a bearing portion 22*e* formed in the right side of the intermediate case member 22, and the right end of the pivot pin 60 is journalled by a bearing portion 21*e* formed in the right case member 21. In the covering 64, the pulley 45 is pivotally supported by a pin 46. The pin 46 supporting the pulley 45 is offset relative to the pivot pin 60 of the sub-lever 51 in such a manner that the axis O' of the pin 46 is upwardly spaced a predetermined distance E apart from the pivotal axis O of the sub-lever 51 (the axis of the pivot pin 60). When the sub-lever 51 is pivoted backwardly, the pulley 45 is moved to the throttle cable drawing direction (backward direction).

Into the top of the sub-lever 51, a top-closed (bottomless) tubular push button 53 is vertically slidably inserted. In the push button 53, a bottom-closed sleeve 57 which is always downwardly biased by a coil spring 56 is fitted. The push button 53 is mounted slidably back and forth with the bottom of the sleeve 57 caused to abut upon a right shoulder of the case member 21.

On a left side of the lower end of the push button 53, a movable serrated portion 58 whose serrations upwardly protrude is provided. In an upper portion of the right case member 21, as well seen with reference to FIGS. 3 and 4, a stationary serrated portion 28 is provided whose serrations protrude downwardly and extend in the longitudinal direction along an arc having its center on the pivotal axis O of the sub-lever 51, and with which the movable serrated portion 58 is engaged.

In the position adjusting mechanism 50 having such a structure, when the push button 53 is pressed, the movable serrated portion 58 and the stationary serrated portion 28 are disengaged from each other. Under this condition, when the push button 53 is backwardly moved to a desired position, the sub-lever 51 is backwardly swung. In consequence thereof, the pulley 45 is moved to the throttle cable drawing direction (backward direction). Then, the push button 53 is released from the pressing force. The movable serrated portion 58 and the stationary serrated portion 28 are thereby brought into engagement again. Consequently, the sub-lever 51 and the pulley 45 are kept at the pivotally operated position.

A slide type cut-off switch 67 is provided in a center portion of the top of the case 20, for cutting off application of current to the spark plug 5 of the internal combustion engine 2 to stop the engine 2, in such a manner that it is held between rectangular notches 21*k*, 23*k* respectively formed in the tops of the right and left case members 21, 23, respectively.

Figure 11:
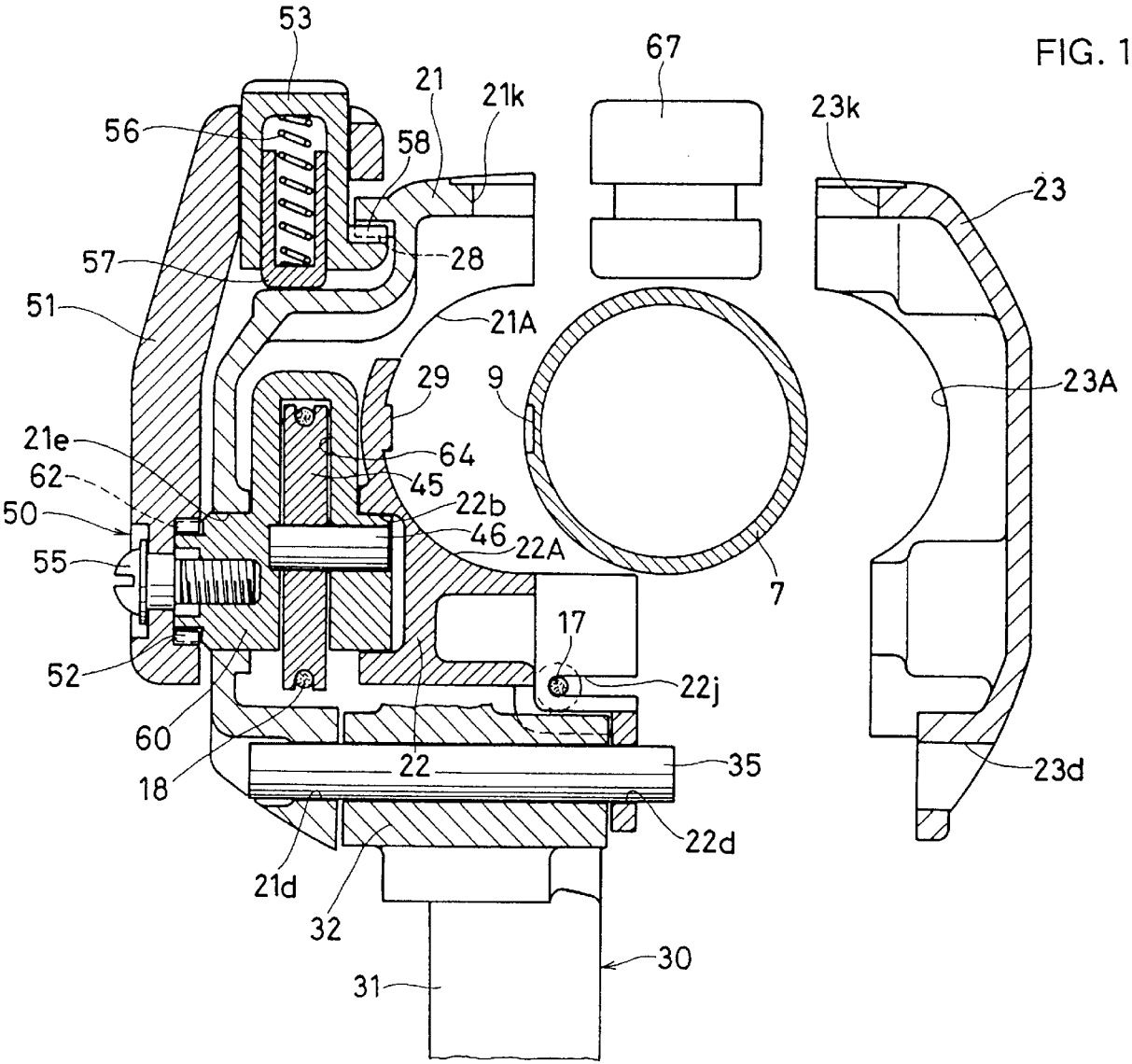
FIG. 11 is an exploded sectional view of the hand lever device shown in FIG. 6, wherein a partial assembly of right and intermediate case members and a left case member are dismounted from a handle.

To mount the hand lever device 10 of this embodiment constructed as described above on the bar handle 7, movable members such as the main lever 30, the draw amount magnifying mechanism 40, the pulley 45 and the position adjusting mechanism 50 are mounted in the right case member 21 and the intermediate case member 21, and the intermediate case member 22 is fixed to the right case member 21 by means of two screws 26 (see FIGS. 5, 10 and 11).

Then, the partial assembly of the right case member 21 and the intermediate case member 22, which bears the movable members such as the main lever 30, the draw amount magnifying mechanism 40, the pulley 45 and the position adjusting mechanism 50, and the left case member 23 are fixed together with the bar handle 7 fixedly held therebetween. In this operation, the protrusion 29 formed in the intermediate case member 22 is fitted into the blind hole 9 formed in the bar handle 7 to effect positioning (as shown in FIG. 6). Thereafter, the left case member 23 and the partial assembly of the right case member 21 and the intermediate case member 22 are fixed together by means of the four bolts 24, 25.

Thus, the right case member 21, intermediate case member 22 and left case member 23 which constitute the case 20 are fixedly mounted on the bar handle 7 at a predetermined position.

With respect to the hand lever device 10 of the embodiment mounted on the bar handle 7 in this manner, the case 20 can be dismounted from the bar handle 7 by detaching the left case member 23 from the partial assembly of the right case member 21 with the intermediate case member 22.

In a time when the case 20 is dismounted and the right case member 21, intermediate case member 22 and left case member 23 which constitute the case 20 are removed from the bar handle 7 as described above, for example, in a time before mounting of the hand lever device 10 on the bar handle 7, or in a time of maintenance, the partial assembly of the right case member 21 and the intermediate case member 22 as such, which bears the movable members such as the main lever 30, the draw amount magnifying mechanism 40, the pulley 45 and the position adjusting mechanism 50, may be left assembled.

By virtue of this, in the hand lever device 10 of this embodiment, mounting thereof on a handle, maintenance and the like can be carried out far easily as compared with conventional hand lever devices of a binary case structure which have a disadvantage that it is difficult to appropriately retain movable members in (one of) case members.

By virtue further of the fact that the case 20 is fixedly mounted on the bar handle 7 with the protrusion 29 fitted in the cavity 9 which are provided in the intermediate case member 22 and the bar handle 7, respectively, the case 20 is prevented from rotating relative to the bar handle 7 and also prevented from moving in the longitudinal direction by the fitting between the cavity 9 and the protrusion 29.

Accordingly, stable operability is always obtained, and shift of the front end of the throttle cable 17 is not caused, and draw amount of the throttle cable 17 is constant with respect to given amounts of operation of the main lever 30 and the position adjusting mechanism 50. Consequently, opening degree of a throttle valve CV or the like can be controlled precisely.

In the hand lever device 10 of this embodiment constructed as described above, when the main lever 30 is pivotally operated to the set position closer to the proximal grip 11 of the bar handle 7, the throttle cable 17 is drawn in a predetermined amount via the draw amount magnifying mechanism 40 utilizing the lever piece 41 and the pulley 45 as a cable turnaround member to eliminate play.

It is to be noted that since the amount of drawing (amount of displacement) of the throttle cable 17 by the main lever 30 is magnified by the draw amount magnifying mechanism 40, angular amount a of the pivotal operation of the main lever 30 can be smaller as compared with those of conventional devices (as shown in FIG. 2). Accordingly, a space for pivotal operation of the main lever 30 can be minimized which is provided between the proximal grip 11 of the bar handle 7 and the main lever 30. This enables a small-sized and light weight device to be realized and leads to improved operability.

Then, when the push button 53 of the position adjusting mechanism 50 is pressed to move the sub-lever 51 to a backward desired position with the main lever 30 kept at the set position, the pulley 45 is caused to move to the throttle cable drawing direction (backward direction). Consequently, the throttle cable 17 is further drawn via the draw amount magnifying mechanism 40 and the pulley 45, and the throttle valve CV is brought from the minimum opening degree (the opening degree for idle running) toward a more opening degree, thereby achieving appropriate control of opening degree of the throttle valve CV.

It is to be noted that the throttle cable 17 is drawn by the pulley 45 with the turnaround cable 18 reeved around the pulley 45, and accordingly, it is drawn in an amount two times the amount of the movement of the pulley 45. Accordingly, the amount of operation of the sub-lever 51 of the position adjusting mechanism 50, in other words, the amount of the movement of the pulley 45 can be reduced which is necessary to appropriately adjust the opening degree of the throttle valve CV. By virtue also of this, a reduced size and light weight device is realized.

It is further to be noted that even if fingers are released from the sub-lever 51, the sub-lever 51 is held immobilized at the operated position by the engagement between the movable serrated portion 58 and the stationary serrated portion 28, thereby keeping the throttle valve CV at the adjusted opening degree (set opening degree). Accordingly, stress on fingers is relieved.

Under such condition as described above in which the opening degree of the throttle valve CV is adjusted, in the event that it is necessary to immediately lower the speed of the engine 10 due to occurrence of accident or the like, the main lever 30 is released. The main lever 30 and the lever piece 41 of the draw amount magnifying mechanism 40 are drawn to the direction reverse to the above-mentioned direction and returned to the original positions, because the throttle cable 17 is always biased toward the direction of minimum valve opening of the throttle cable CV. In consequence, the throttle cable 17 is returned to the non-operated condition and the throttle valve CV is returned to the above-mentioned opening degree for idling. The engine 10 is thereby brought into its idle condition. In the case of the working machine 1 adapted to be such that rotational driving force of the engine 2 is transmitted to the operative portion 3 including cutting blade 13 and the like via a centrifugal clutch, the centrifugal clutch is brought into its disconnective condition to cut off the transmission of the driving force to the operative portion 3, thereby immediately stopping the operation of the operative portion 3 including the cutting blade 13 and the like.

When the main lever 30 is again pivotally operated to move to the set position closer to the proximal grip 11 of the bar handle 7 after having been once released, the play of the throttle cable 17 is eliminated with the sub-lever 51 of the position adjusting mechanism 50 is still immobilized at the previous operated position. Consequently, the throttle valve CV is returned to the opening degree at which it had stood before the main lever 30 was released, without necessity of readjusting the sub-lever 51.

As described above, in the hand lever device 10 of this embodiment, opening degree of the throttle valve CV as a driven member is adjusted via the cable 17, and the throttle valve CV can be kept at a desired opening degree and can also immediately be returned to the minimum opening degree (opening degree for idling). This ensures high safety and reduces fatigue of fingers. Further, when it is intended that the throttle valve CV should be set to the opening degree at which it had stood before the throttle valve CV was returned to the opening degree for idling, readjusting is not required. Moreover, realization of a reduced size and light weight device is effectively achieved and improved operability is obtained.

The present invention has been described in detail with reference to the one embodiment. It is, however, to be understood that the present invention is by no means restricted to the above-described embodiment, and that various modifications may be made within the scope which does not depart from the spirit of the present invention as defined in the claims.

For example, in the above description, the hand lever device 10 is used to control opening degree of the throttle valve CV of the internal combustion engine 2. It is, however, to be understood that the hand lever device of the present invention may, of course, be used in other applications than adjustment of opening degree of the throttle valve CV.

Further, the hand lever device 10 as such may be used by mounting it on a U-shaped handle and the like besides the bar handle 7.

As understood from the above description, according to the hand lever device of the present invention, the movable members such as main lever may appropriately be retained in case members even in a time when the case is dismounted or separated from the handle. In consequence, mounting thereof on the handle and maintenance can be carried out with ease.

By virtue further of the fact that the case is fixedly mounted on the handle with the protrusion fitted in the cavity which are provided in the handle and one of the case members, the case is prevented from rotating relative to the handle and also prevented from moving in the longitudinal direction by the fitting between the cavity and the protrusion. Accordingly, stable operability is always obtained, and shift of the front end of the throttle cable is not caused, and draw amount of the throttle cable is constant with respect to given amounts of operation of the main lever and the position adjusting mechanism. Consequently, opening degree of a throttle valve CV or the like can be controlled precisely.

What is claimed is:

1. A hand lever device (10) comprising:

a case (20) to be mounted on a handle (7), and a main lever (30) pivotally supported by the case (20) for drawing a cable (17) connected to a driven member (CV), wherein said case (20) has a ternary structure composed of one side case member (21), an intermediate case member (22) and the other side case member (23); and said case (20) is dismounted from the handle (7) by detaching the other case member (23) from the one side case member (21) and the intermediate case member (22); and said main lever (30) is retained between the one side case member (21) and the intermediate case member (22) even in a time when said case (20) is dismounted or separated from the handle (7).

2. A hand lever device (10) comprising:

a case (20) to be mounted on a handle (7), a main lever (30) pivotally supported by the case (20) for drawing a cable (17) connected to a driven member (Cv), and a draw amount magnifying mechanism (40) interposed between the main lever (30) and the throttle cable (17) in the case (20) for magnifying amount of drawing of the cable (17) by the main lever (30), wherein said case (20) has a ternary structure composed of one side case member (21), an intermediate case member (22) and the other side case member (23); and said case (20) is dismounted from the handle (7) by detaching the other case member (23) from the one side case member (21) and the intermediate case member (22); and said main lever (30) and said draw amount magnifying mechanism (40) are retained between the one side case member (21) and the intermediate case member (22) even in a time when said case (20) is dismounted or separated from the handle (7).

3. The hand lever device according to claim 1 or 2, wherein said main lever (30) is connected via a cable turnaround member (45) to the throttle cable (17) connected to the driven member (CV); and said hand lever device (10) is provide with a position adjusting mechanism (50) for holding said cable turnaround member (45) at a desired position; and said cable turnaround member (45) and said position adjusting mechanism (50) are retained between the one side case member (21) and the intermediate case member (22) even in a time when said case (20) is dismounted or separated from the handle (7).

4. The hand lever device according to any one of claim 1 or 2, wherein one of said handle (7) and said case (20) is provided with a cavity (9) and the other is provided with a protrusion (29) to be fitted in the cavity (9).

5. The hand lever device according to claim 4, wherein said handle (7) is tubular and provided with a blind hole as the cavity (9), and said intermediate case member (22) is provided with a protrusion (29) to be fitted in the cavity (9).

6. The hand lever device according to claim 2, wherein said draw amount magnifying mechanism (40) comprises a lever piece (41).

7. The hand lever device according to claim 3, wherein said position adjusting mechanism (50) has a sub-lever (51), and said cable turnaround member (45) is offset relative to the pivotal axis (0) of the sub-lever (51).

8. The hand lever device according to claim 3, wherein said cable turnaround member (45) is a pulley.

9. The hand lever device according to any one of claims 1 or 2, wherein said driven member is a throttle valve CV of an internal combustion engine (2).

* * * * *